US005483867A

United States Patent [19]

Ikeda et al.

[11] Patent Number: 5,483,867

[45] Date of Patent: Jan. 16, 1996

[54] SWASH PLATE COMPRESSOR WITH SUFFICIENTLY LUBRICATED SHOES

[75] Inventors: Hayato Ikeda; Tatsuya Nakai; Naoya Yokomachi; Masanobu Yokoi, all of Kariya, Japan

[73] Assignee: Kabushiki Kaisha Toyoda Jidoshokki Seisakusho, Aichi, Japan

[21] Appl. No.: 313,357

[22] Filed: Sep. 27, 1994

[30] Foreign Application Priority Data

Oct. 1, 1993 [JP] Japan ..... 5-246712

[51] Int. Cl.[6] ..... F01B 3/00

[52] U.S. Cl. ..... 92/71; 417/269; 74/60; 91/499

[58] Field of Search ..... 92/12.2, 71; 417/269; 74/60; 91/499

[56] References Cited

U.S. PATENT DOCUMENTS

| | | | |
|---|---|---|---|
| 3,968,699 | 7/1976 | van Beukering | 74/60 |
| 4,568,252 | 2/1986 | Hattori et al. . | |
| 4,683,804 | 8/1987 | Futamura et al. | 92/71 |
| 4,781,539 | 11/1988 | Ikeda et al. . | |
| 5,228,841 | 7/1993 | Kimura et al. | 417/269 |

FOREIGN PATENT DOCUMENTS

| | | | |
|---|---|---|---|
| 0051977 | 3/1982 | Japan . | |
| 0049081 | 3/1982 | Japan | 74/60 |
| 0146070 | 9/1982 | Japan . | |

*Primary Examiner*—Thomas E. Denion
*Attorney, Agent, or Firm*—Burgess, Ryan and Wayne

[57] ABSTRACT

A swash plate type compressor incorporating therein a swash plate having an annular rail raised from each flat face thereof for providing a sliding-contact surface being in contact with sliding-contact surface portions of respective shoes which constitute a rotation-to-reciprocation conversion unit arranged between the swash plate and double-headed pistons reciprocating axial cylinder bores of the compressor. The sliding-contact surfaces of respective shoes bulge outward and have a radius of curvature "R" in the range of 800 through 1600 millimeters which is smaller than that of the conventional shoes of a swash plate type compressor, so that relatively large wedge shaped gaps are formed between the respective shoes and the swash plate to thereby stably and constantly hold lubricating oil.

6 Claims, 5 Drawing Sheets

SWASH PLATE COMPRESSOR WITH SUFFICIENTLY LUBRICATED SHOES

BACKGROUND OF THE INVENTION

1. Field of the Invention

The present invention relates to a swash plate type compressor adapted for being incorporated into a climate control system for automobiles, and more particularly, relates to a swash plate type compressor with shoes arranged between a swash plate and reciprocating pistons in such a manner as to be sufficiently lubricated by a lubricating oil suspended in a refrigerant gas during the compression of the refrigerant gas.

2. Description of the Related Art

Swash plate type compressors have been conventionally used in a climate control system for automobiles, in order to compress refrigerant gas which is a thermal exchange medium in the climate control system.

In the swash plate type compressor, for example, a pair of axially combined cylinder blocks are provided with a plurality of axial cylinder bores arranged to be parallel to one another while allowing double-headed pistons fitted therein to reciprocate for compressing the refrigerant gas delivered toward the climate control system. The compressor is further provided with a drive shaft axially extending through the combined cylinder block and arranged in parallel with the cylinder bores. The drive shaft is rotatably supported and has a middle portion to which a swash plate is secured so as to rotate together with the drive shaft.

The swash plate has opposite circular surfaces arranged so as to be inclined with respect to the axis of rotation of the drive shaft, and the marginal portion of the surfaces of the swash plate is engaged with the double-headed pistons via a rotation-to-reciprocation conversion means including shoes in the form of semispherical elements. Namely, the shoe of the rotation-to-reciprocation conversion means has a semispherical surface portion slidably engaged with a roundly recessed socket formed in a central portion of each piston, and an opposite flat surface portion slidably engaged with the marginal portion of the swash plate.

The swash plate rotating with the drive shaft is housed in a swash plate chamber centrally formed in the combined cylinder blocks, and the axially opposite ends of the combined cylinder blocks are closed by front and rear housings. Both housings are sealably attached to the ends of the combined cylinder blocks, via valve plates, and define therein a suction chamber for refrigerant gas before compression, and a discharge chamber for the compressed refrigerant gas.

With the described swash plate type compressor, when the drive shaft and the swash plate are rotated together about the axis of rotation of the shaft by an externally applied drive force, the opposite surfaces of the swash plate nutate so as to provide the respective double-headed pistons with an axial force via the shoes of the rotation-to-reciprocation conversion means, and accordingly, the double-headed pistons are reciprocated in the respective cylinder bores of the combined cylinder blocks.

During the operation of the compressor, all moving elements of the compressor such as the swash plate, the shoes, the reciprocating pistons, and ball and thrust bearings accommodated in the compressor are lubricated by lubricating oil contained in the refrigerant gas which is circulated through the climate control system, and is eventually introduced from an evaporator into the swash plate chamber of the compressor via a suction conduit. When considering the lubrication of the shoes, the flat surface portions of the respective shoes which are constantly in sliding contact with the marginal portions of the opposite surfaces of the swash plate must be sufficiently lubricated by the lubricating oil. Nevertheless, the lubricating oil suspended in the refrigerant gas introduced into the swash plate chamber is centrifugally dispersed away from the swash plate without wetting the contact portions of the flat surface portions of the shoes and the marginal portions of the swash plate. Accordingly, the flat surface portions of the shoes in sliding contact with the marginal portion of the swash plate is apt to become dry due to insufficient supply of the lubricating oil.

In order to solve this problem, for example, Japanese Unexamined Patent publication (Kokai) No. 57-49081 disclosed one proposal for providing a means for effectively lubricating respective flat portions of the shoes sliding on the marginal portions of the swash plate of a swash plate type refrigerant compressor. In accordance with the proposed means for effectively lubricating the shoes, the flat surface portions of the respective shoes opposite to the spherical portions are provided with a smooth bulged surface having an extremely large radius of curvature, namely, the bulged surface of each shoe is formed so that the maximum height thereof is equal to or less than 15 micrometers, preferably, approximately 2 through 5 micrometers. The bulged surface of the shoe in sliding contact with the swash plate contributes to formation of a thin wedge-like gap between the contacting portion of both elements, i.e., the shoes and the swash plate. Thus, when the lubricating oil contained in the refrigerant gas is attached to the swash plate,it is easily caught by the wedge-like gap during rotation of the swash plate so as to form a wedge-like oil film capable of constantly lubricating the contacting portions of the shoes and the swash plate. Consequently, seizure of the shoes can be prevented.

In the case of the swash plate type compressor discussed in Japanese unexamined Patent Publication (Kokai) No. 57-49081, the swash plate type compressor employs shoes having a diameter of 13.5 millimeters and provided with bulged sliding contact surface portions of which the radius of curvature was determined to be between 4,500 and 11,400 millimeters. Therefore, the maximum height of the bulged surface portion of the shoe is approximately 2 through 5 micrometers.

In spite of the above-mentioned provision of effective lubricating means for the shoes of a swash plate type compressor, the sliding contact portions between the shoes and the swash plate cannot be sufficiently lubricated when the compressor is running at a low speed, and accordingly, when the supply of the lubricating oil is absolutely reduced.

SUMMARY OF THE INVENTION

Accordingly, an object of the present invention is to obviate the above-mentioned defects encountered by the conventional shoes and swash plate accommodated in a swash plate type refrigerant compressor having double-headed pistons.

Another object of the present invention is to provide a novel structure of a shoe and a swash plate accommodated in a swash plate type compressor, with which insufficient supply of the lubricating oil can be positively prevented irrespective of low running speed of the compressor.

In accordance with the present invention, there is provided a swash plate type compressor which includes a cylinder block assembly having therein a plurality of axial cylinder bores, a plurality of double-headed pistons fitted in the respective cylinder bores, a swash plate having opposite faces and secured to a drive shaft supported in the cylinder block assembly so as to be rotated about an axis of rotation, and a rotation-to-reciprocation conversion means including a plurality of shoes arranged between the swash plate and the respective double-headed pistons, each of the shoes being provided with a semispherical surface portion slidably engaged with a spherically recessed socket formed in the cooperating one of the double-headed pistons, and an opposite sliding contact surface portion being in sliding contact with a cooperating flat face portion formed in a generally marginal portion of the swash plate, said sliding contact surface portion of each of said shoes being formed as a round surface bulging outward from a flat base and having a predetermined radius of curvature "R" of 800 through 1600 millimeters.

Preferably, the cooperating flat face portion of the swash plate comprises an annular rail circumferentially extending in the marginal portion of each face of the swash plate in such a manner that the annular rail is raised from the remaining region of each of the opposite faces of the swash plate providing a flat surface region thereof cooperating with the sliding contact surface portions of the respective shoes.

In the above-described structure of the shoes and the swash plate, the sliding contact surface portion of each shoe and the cooperating flat face portion, i.e., the annular rail of the swash plate define a wedgelike gap into which the lubricating oil attaching to the cooperating flat face portion is drawn in response to rotation of the swash plate while forming an oil film lubricating the sliding contact surface portion of the shoe.

At this stage, since the sliding contact surface portion of the shoe is formed as the round surface having a predetermined radius of curvature "R" ranging from 800 through 1600 millimeters which is smaller than that of the conventional shoe of the swash plate type compressor, the wedgelike gap has an acute angle thereof less sharp than that in the case of the afore-mentioned conventional shoe, and accordingly, a whole contacting area of each shoe and the cooperating flat face portion of the swash plate is reduced. It should be understood that as the above-mentioned wedgelike gap between the shoes and the swash plate has a wider opening compared with the conventional wedgelike gap, heat generated from the contacting portions of the shoe and the swash plate can easily dispersed.

Further, during the rotation of the swash plate, the respective shoes are forced to roll in the spherically recessed sockets of the reciprocating double-headed pistons in response to reciprocation of the respective pistons. However, since the wedgelike gap can be stably preserved between the respective sliding contact surface portions of the shoes and the annular rail of the swash plate without occurrence of breakage of the oil film, the sliding contact surface portions of the shoes can be constantly lubricated by the lubricating oil suspended in the refrigerant gas.

It should be understood that if the radius of curvature "R" of the sliding contact surface of the shoe is determined to be less than 800 millimeters, the sliding contact surface of the shoe will be subjected to a larger face pressure resulting in an increase in the amount of abrasion of the shoes and the swash plate.

On the other hand, if the radius of curvature "R" of the of the sliding contact surface of the shoe is determined to be larger than 1600 millimeters, an effective oil film is not formed.

The cooperating flat face portion of the swash plate, i.e., the annular rail formed in the marginal portion of the swash plate so as to be raised from the remaining region can contribute to dispersion of heat from the swash plate per se, and accordingly, insufficient supply of lubricating oil can be positively and effectively prevented.

BRIEF DESCRIPTIONS OF THE DRAWINGS

The above and other objects, features and advantages of the present invention will be more apparent from the ensuing description of preferred embodiments of the present invention in conjunction with the accompanying drawings wherein.

DESCRIPTION OF THE PREFERRED EMBODIMENTS

Figure 1:
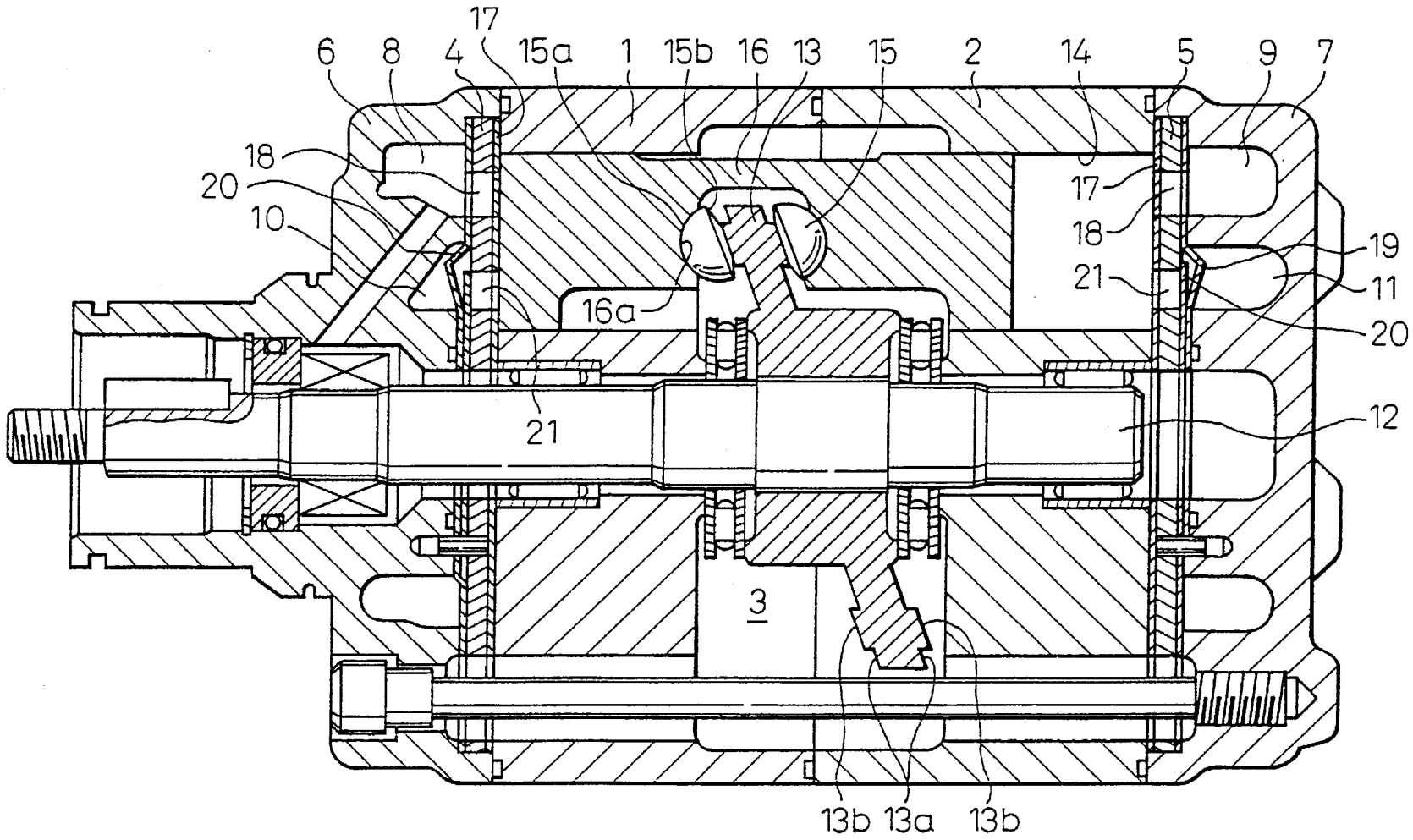
FIG. 1 is a longitudinal cross-sectional view of a swash plate type compressor having double-headed pistons, and incorporating therein a swash plate and shoes according to an embodiment of the present invention.

Referring to FIG. 1, a swash plate type refrigerant compressor is provided with a pair of cylinder blocks, i.e., front and rear cylinder blocks 1 and 2 axially combined together so as to form a cylinder block assembly having a suction inlet (not illustrated in FIG. 1) for introducing a refrigerant gas from an external climate control system, at a position corresponding to the combining portion of the front and rear cylinder blocks 1 and 2. The combined cylinder blocks 1 and 2 define a swash plate chamber 3 at an axially middle portion of the assembly so that the swash plate chamber 3 is communicated with the inlet port. The ends of the axially combined front and rear cylinder blocks 1 and 2 are closed by front and rear housings 6 and 7 via front and rear valve plates 4 and 5. The front and rear housings 6 and 7 are provided with outer suction chambers 8 and 9, and inner discharge chambers 10 and 11, respectively. The outer suction chambers 8 and 9 are arranged radially outside the inner discharge chambers 10 and 11. The suction chambers 8 and 9 are communicated with the swash plate chamber 3 via respective suction passageways (not illustrated in FIG. 1), and the discharge chambers 10 and 11 are communicated with the swash plate chamber 3 respective discharge passageways (not illustrated in FIG. 1). The rear discharge chamber 11 is further communicated with an outlet port (not illustrated in FIG. 1) through which the refrigerant gas after compression is delivered toward the external climate control system.

The combined cylinder blocks 1 and 2 are provided with a common central bore through which an axial drive shaft 12 is inserted so as to be rotatably supported by a pair of radial bearings. The drive shaft 12 has a front end extending beyond the end of the front cylinder block 1 and through the front valve plate 4 and the front housing 6.

A swash plate 13 is secured to the middle portion of the drive shaft 12 and received in the swash plate chamber 3 so as to be rotated with the drive shaft 12. The swash plate 13 is supported by the front and rear cylinder blocks 1 and 2 via thrust bearings. The combined cylinder blocks 1 and 2 are provided with a plurality of pairs of axial cylinder bores 14 arranged around and in parallel with the axis of rotation of the drive shaft 12. In the respective pair of cylinder bores 14, a plurality of double-headed pistons 16 are axially slidably fitted in order to carry out suction, compression, and discharge of the refrigerant gas. The respective pistons 16 have an axially central portion recessed so as to receive a pair of shoes 15 which are engaged with the marginal portion of the swash plate 13.

Each shoe 15 has a generally semisphere shape, and is provided with a semispherical surface portion 15*a*, and a round sliding-contact surface portion 15*b* appreciably bulging outward with respect to a flat base at which both portions 15*a* and 15*b* are integrally connected to one another. The semispherical portion 15*a* of the shoe 15 is slidably engaged in a spherically recessed socket 16*a* formed in the middle portion of the double-headed piston 16. The round sliding-contact surface portion 15*b* of the shoe 15 is in slide-contact with a cooperating face 13*b* of the swash plate 13. The swash plate 13 is preferably made of an alloy of aluminum and silicon, and the respective shoes 15 are made of steel.

In a preferred embodiment, the round sliding-contact surface 15*b* of the shoe 15 has a radius of curvature "R" of 1000 millimeters, and an apex located at the center of the round sliding-contact surface 15*b*. The shoe 15 is formed so as to have approximately 15 millimeters width.

The swash plate 13 has opposite faces 13*a* inclining from a plane perpendicular to the axis of rotation of the drive shaft 12, and provided with, at the marginal portion thereof, a raised portion 13*b* acting as an annular rail coming in contact with the round-contact surface 15*b* of the shoe 15 during rotation of the swash plate 13. The annular rail of the raised portion 13*b* has 8 millimeters width and 2 millimeters depth from the corresponding face 13*a* of the swash plate 13. The corners of the annular rail 13*b* are chamfered so as to prevent the round sliding-contact surfaces 15*b* of the shoes being damaged.

The front and rear valve plates 4 and 5 are formed with a plurality of suction ports 18 in the form of through-bores in order to provide a fluid communication between the suction chambers 8 and 9, and the cylinder bores 14. The suction ports 18 are covered by suction valves 17, respectively, which are moved toward an open position from a closed position thereof by suction pressure of the refrigerant gas, and the opening amount of each suction valve 17 is restricted by a cut formed in the end of the front and rear cylinder block 1 and 2 at a position adjacent to the respective cylinder bores 14.

The front and rear valve plates 4 and 5 are also formed with a plurality of discharge ports 21 in the form of through-bores in order to provide a fluid communication between the discharge chambers 10 and 11, and the respective cylinder bores 14. The discharge ports 21 are covered by discharge valves 20 arranged in the discharge chambers 10 and 11. The discharge valves 20 are moved toward an open position thereof from a closed position thereof, and the opening amount of each of the discharge valves 20 is restricted by retainers 19.

When the compressor is in operation, the drive shaft 12 is rotated by an external drive force, i.e., a drive power transmitted from an engine of an automobile, and the swash plate 13 is rotated together so as to cause the reciprocation of the double-headed pistons 16 in the respective cylinder bores 14. Further, refrigerant gas coming from an evaporator of the external climate control system is introduced into the swash plate chamber 3 via the afore-mentioned inlet port (not illustrated in FIG. 1), and is further introduced into the suction chambers 8 and 9 via the suction passageways (not illustrated in FIG. 1). During the reciprocation of the double-headed pistons 16, the refrigerant gas is successively pumped into the respective cylinder bores 14 through the suction ports 18 in response to the movement of the suction valves 17 from the closed position in contact with the valve plates 4 and 5 toward the opening position thereof. When the suction of the refrigerant gas from the suction chamber 8 and 9 into the respective cylinder bores 14 is carried out, the discharge valves 20 are maintained at the closing position thereof whereat the discharge ports 21 of the valve plates 4 and 5 are closed so as to prevent a fluid communication between the cylinder bores 14 and the discharge chambers 10 and 11.

After completion of the suction of the refrigerant gas into the cylinder bores 14, the respective pistons 16 compress the refrigerant gas within the cylinder bores 14 to thereby increase pressure of the refrigerant gas within the cylinder bores 14, and accordingly, the discharge valves 20 are opened by the increased pressure of the compressed refrigerant gas, and the compressed refrigerant gas is discharged from the cylinder bores 14 into the discharge chambers 10 and 11. During the discharge of the compressed refrigerant gas, the suction valves 17 are moved by the pressure of the compressed refrigerant gas toward the closing position thereof covering the suction ports 17. Thus, a fluid communication between the respective cylinder bores 14 and the suction chambers 8 and 9 are prevented.

The compressed refrigerant gas flowing into the discharge chamber 10 on the front side is carried into the discharge chamber 9 in the rear side, via a discharge passageway (not illustrated in FIG. 1), and is collected there. Then, the compressed refrigerant gas is delivered toward the external climate control system through an outlet port of the compressor.

Figure 2:
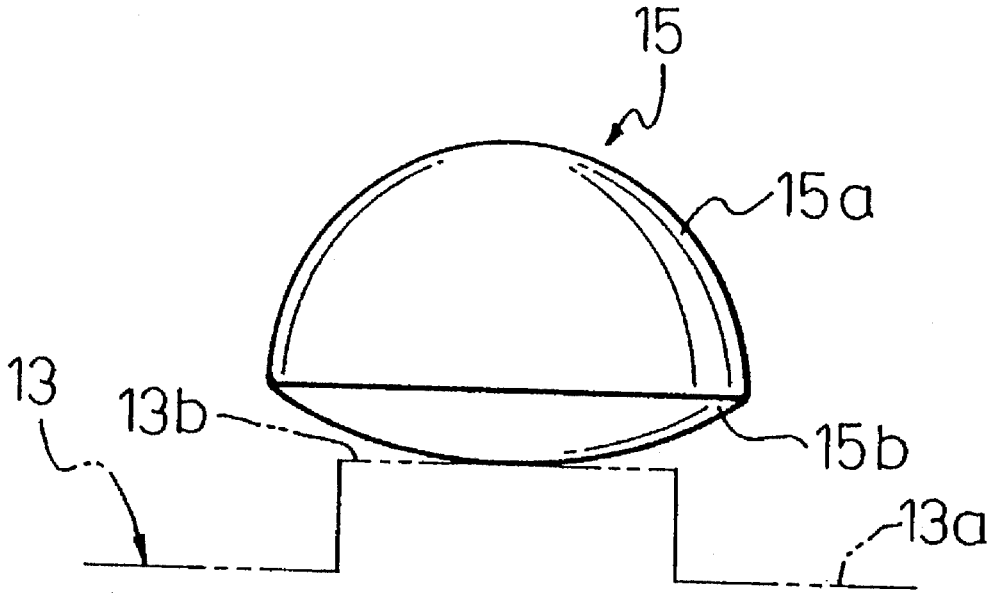
FIG. 2 is a schematic side view of a shoe in contact with an annular rail of a swash plate, according to an embodiment of the present invention.

During the operation of the above-described embodiment of the swash plate type compressor, the round sliding-contact surface portions 15*b* of the respective shoes 15 having the predetermined radius of curvature "R" of 1000 millimeters come into contact with the cooperating sliding-contact face portion of the swash plate 13 in the form of raised annular rail 13*b* having a width smaller than that of respective shoes 15. Accordingly, as is best shown in FIG. 2, a pair of wedge shaped gaps are formed between the round sliding-contact surface portions 15 of each shoe 15 and the lateral sides of the annular rail 13*b* of the wash plate 13. The wedge shaped gaps are widely opened at the lateral sides of the annular rail 13*b* of the swash plate 13 and the arcuate edge of both wedge shaped gaps come close to the apex of the round sliding-contact surface portion of the shoe 15. Therefore, lubricating oil attached to the raised rail 13*b* of the swash plate 13 is forced to flow into the wedge shaped gaps in response to the rotation of the swash plate 13, and is constantly held in the wedge shaped gaps to thereby form a stable oil film in the wedge shaped gaps. Therefore, the oil film constantly lubricates the sliding-contact region of the shoes and the swash plate 13. Since the radius of curvature "R" of the round sliding-contact surface portions of the respective shoes 15 is 1000 millimeters which is sufficiently smaller than that of the conventional shoes of a swash plate type refrigerant compressor, the sliding-contact area of the shoes 15 of the described embodiment with the annular contacting face portion, i.e., the annular rail 13*b* formed in the marginal portion of the face 13*a* of the swash plate 13, can be smaller compared with the case of the conventional shoes. Accordingly, heat generation from the above-mentioned contacting area can be reduced. Further, the lateral openings of the wedged gaps between each shoe 15 and the annular rail 13*b* of the swash plate 13 are wide enough for facilitating the heat generated from the contact portions of the shoes 15 and the annular rail 13*b* of the swash plate 13 to be dispersed outward.

Moreover, the annular rail 13*b* is raised from the face 13*a* of the swash plate 13, and accordingly, a large spacing is provided around the sliding-contact portions of the shoes 15 and the cooperating contact face portion, i.e., the annular rail 13*b* of the swash plate 13. Therefore, the dispersion of the heat is greatly enhanced.

The large spacing provided oil both sides of the annular rail 13*b* of the swash plate 13 also permits the refrigerant gas to flow through the spacing so as to cool the shoes 15 and the annular rail 13*b* of the swash plate 13. Accordingly, occurrence of the seizure of the shoes 15 is further prevented.

In addition, since the wedged gaps formed between the round sliding-contact surfaces 15*b* of the shoes 15 and the annular rail 13*b* open wide on the lateral sides of the annular rail 13*b* of the swash plate 13, the oil film formed in the wedge shaped gaps is not broken even when the respective shoes 15 are gradually moved in the spherical sockets of the double-headed pistons 16 by the reciprocation of the pistons 16. Namely, during reciprocation of the piston 16, each shoe 15 is forced by the nutating swash plate 13 to gradually change its position within the spherical socket of the piston 16. As a result, the shoe 15 is moved within the spherical socket of the piston 16. This movement of the shoe 15 reduces the wedge shaped gap. Nevertheless, the breakage of the oil film formed in the wedge shaped gaps does not occur according to the appropriate design of the radius of curvature "R" of the round sliding-contact surface portions 15*b* of respective shoes 15. Thus, the shoes 15 and the swash plate 13 are constantly and effectively lubricated and cooled. Therefore, seizure of the shoes 15 can be prevented even if the compressor continues to run for a long operation time.

The afore-mentioned large spacing provided around the round sliding-contact surfaces 15*b* and the annular rail 13*b* of the swash plate 13 can also contribute to a substantial increase in an area of a flowing passage for the refrigerant gas within the swash plate chamber 3 (FIG. 1), and therefore, the performance of the swash plate type refrigerant compressor can be enhanced.

Figure 3:
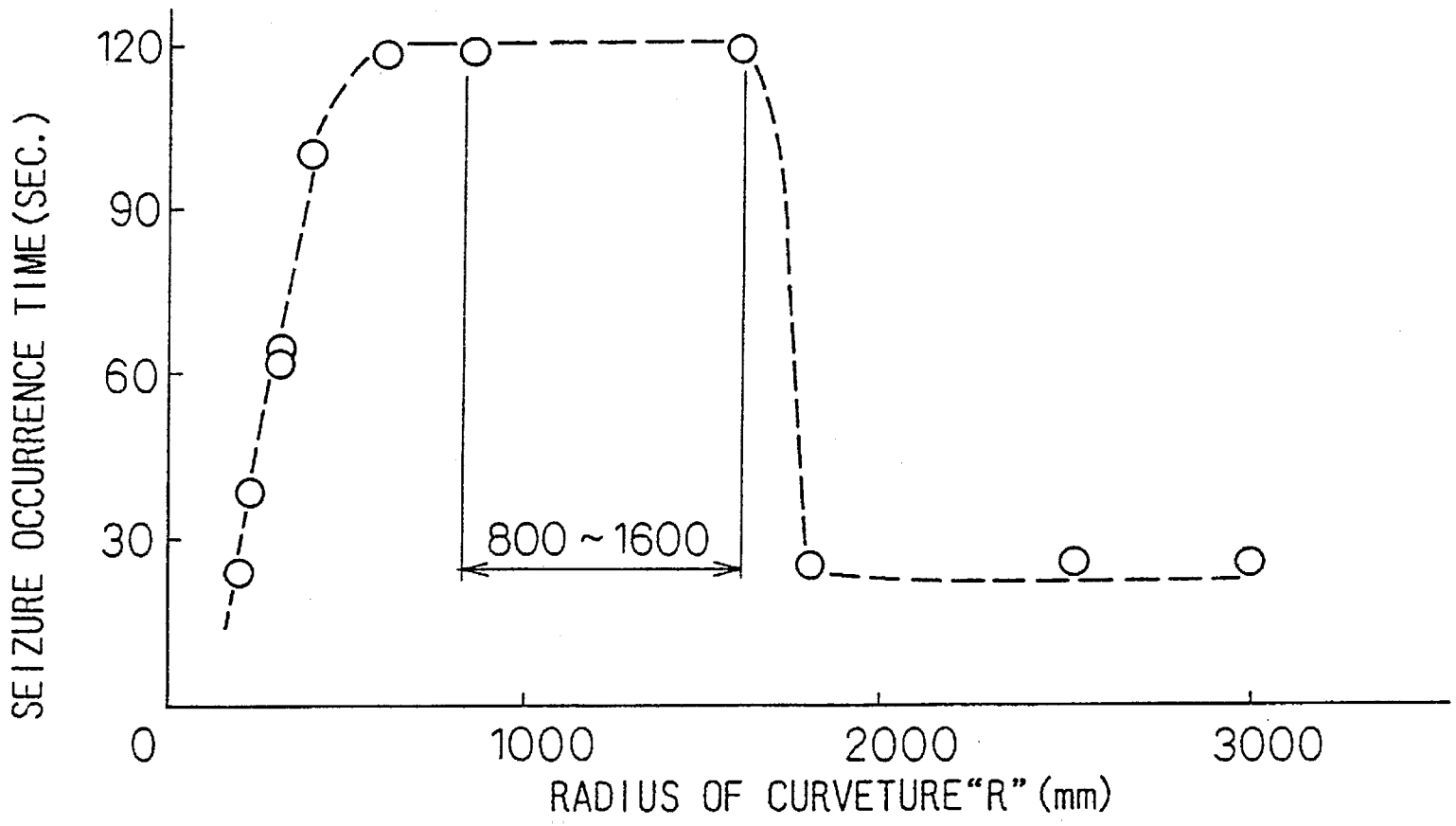
FIG. 3 is a graph indicating a relationship between the radius of curvature "R" of a round surface of a shoe in contact with an annular rail of a swash plate and a duration before occurrence of seizure of the shoe.
Figure 4:
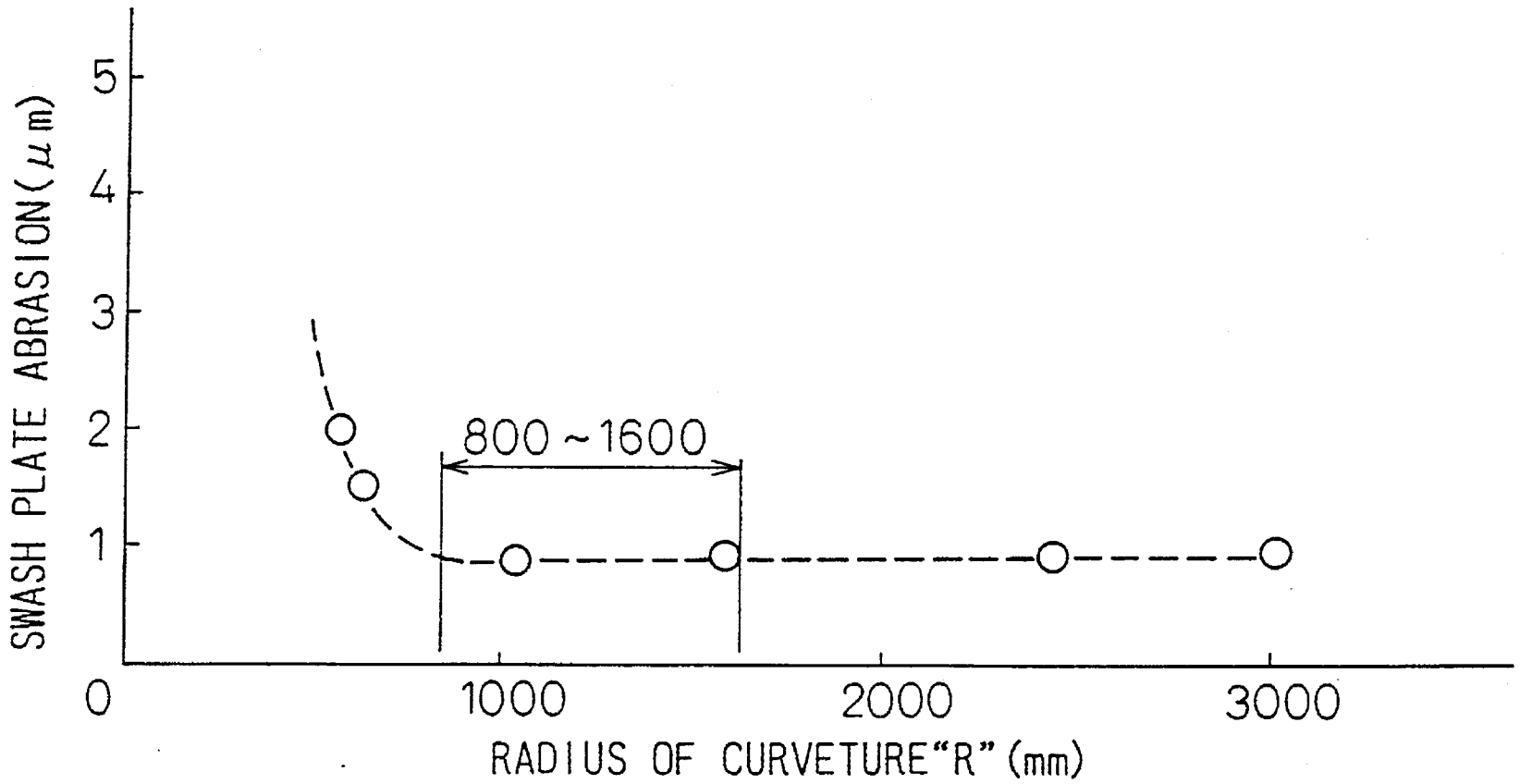
FIG. 4 is a graph indicating a relationship between the radius of curvature "R" of a round surface of a shoe in contact with an annular rail of a swash plate and an amount of abrasion of the swash plate.

FIGS. 3 and 4 indicate various advantageous effects obtained by the use of the shoes 15 according to the present invention on the basis of experiments of compression of the refrigerant, conducted by employing a swash plate type refrigerant compressor in which the shoes 15 and the swash plate 13 according to the present invention are incorporated.

In the graphs of FIGS. 3 and 4, the abscissa commonly indicates radius of curvature "R" (millimeters) of the round sliding-contact surface 15*b* of the shoe 15, and the ordinate indicates time duration (seconds) before occurrence of seizure of the shoe (FIG. 3), and an amount (millimeters) of abrasion of the raised annular rail 13*b* of the swash plate 13 (FIG. 4), respectively.

From FIGS. 3 and 4, it will be understood that when the radius of curvature "R" of the round sliding-contact surface 15*b* of the shoe 15 is larger than 1600 millimeters, seizure of the shoe 15 easily takes place in a short duration from starting of the operation of the compressor. On the other hand, when the radius of curvature "R" is smaller than 800 millimeters, abrasion of the annular rail 13*b* of the swash plate 13 is appreciably increased. Thus, it is obviously understood that the radius of the curvature "R" should be determined so as to be in the range of 800 through 1600 millimeters.

Figure 5:
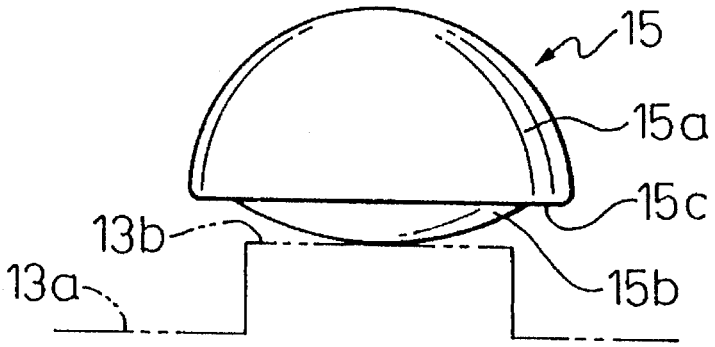
FIG. 5 is a schematic side view of a shoe in contact with an annular rail of a swash plate, according to another embodiment of the present invention; and, FIG. 6 is a partial cross-sectional view of a swash plate according to a variation of the present invention.

FIG. 5 illustrates a different embodiment of the shoe 15 in which although the radius of curvature "R" of the round sliding-contact surface 15*b* of the shoe 15 is unchanged from the above-mentioned range of 800 through 1600 millimeters, the radius of curvature of the semispherical surface portion 15*a* of the shoe 15 is increased in comparison with the shoe 15 of FIG. 2. Thus, as shown in FIG. 5, a flat annular shoulder 15*c* is provided between the round sliding-contact surface 15*b* and the semispherical surface portion 15*a* of the shoe 15. It should, however, be understood that the same advantageous effect as that described above can be derived from the shoe 15 of FIG. 5.

Figure 6:
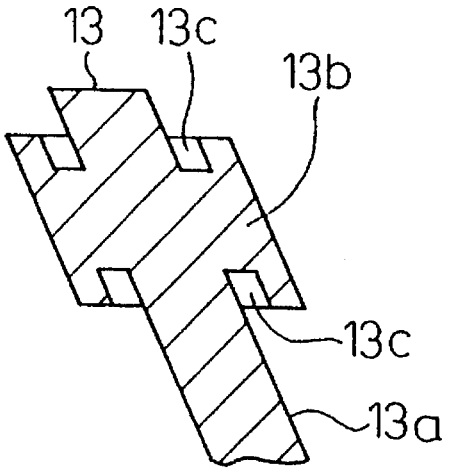

FIG. 6 illustrates a modification of the swash plate 13 in which the annular rail 13*b* raised from the surface 13*a* of the swash plate 13 is provided with recesses 13*c* formed, in the lateral sides of the annular rail 13*b*. The recesses 13*c* annularly extend so as to enhance both heat dispersion effect and cooling effect exhibited by the refrigerant gas flowing through the annular recesses 13*c*. In addition, an increase in the area of the flowing passageway for the refrigerant gas within the swash plate chamber 3 can be obtained.

From the foregoing description of the preferred embodiments of the present invention, it will be understood that in accordance with the present invention, the shoes and the swash plate incorporated in a swash plate type refrigerant compressor can be effectively prevented from seizing by improved structures thereof, to thereby guarantee an extended operation life of the compressor.

It should be understood that many variations and modifications will occur to a person skilled in the art without departing from the spirit and scope of invention as claimed in the accompanying claims.

We claim:

1. A swash plate type refrigerant compressor comprising:

a cylinder block assembly having therein a plurality of axial cylinder bores;

a plurality of double-headed pistons fitted in said cylinder bores, respectively;

a swash plate having opposite faces and secured to a drive shaft supported in said cylinder block assembly so as to be rotated about an axis of rotation; and a rotation-to-reciprocation conversion means including a plurality of shoes arranged between said swash plate and respective ones of said double-headed pistons, each of said shoes being provided with a semispherical surface portion slidably engaged with a spherically recessed socket formed in cooperating one of said double-headed pistons, and an opposite sliding-contact surface portion being in sliding-contact with a cooperating flat face portion formed in a generally marginal portion of said swash plate, said sliding contact surface portion of each of said shoes being formed as a round surface bulging outward from a flat base and having a predetermined radius of curvature "R" of 800 through 1600 millimeters.

2. A swash plate type refrigerant compressor according to claim 1, wherein said cooperating flat face portion of said swash plate comprises an annular rail circumferentially extending in said marginal portion of each face of said swash plate in such a manner that said annular rail is raised from a remaining region of each of the opposite faces of said swash plate, said annular rail providing a flat surface region thereof cooperating with said sliding-contact surface-portions of respective said shoes.

3. A swash plate type refrigerant compressor according to claim 2, wherein said round surface of said sliding-contact surface portion of each of said shoes is provided with an apex located at a center thereof and coming into contact with said flat surface region of said annular rail of said swash plate to thereby define wedge shaped gaps on both sides of said annular rail of said swash plate.

4. A swash plate type refrigerant compressor according to claim 2, wherein said annular rail raised from said each face of said swash plate is provided with a plurality of annularly extending recesses formed in both sides of said annular rail.

5. A swash plate type refrigerant compressor according to claim 1, wherein each of said shoes is provided with an annular shoulder extending between said semispherical surface portion and said round sliding-contact surface portion.

6. A swash plate type refrigerant compressor according to claim 1, wherein said swash plate is made of aluminum alloy, and said shoes are made of steel.

* * * * *